United States Patent [19]

DeWoolfson et al.

[11] Patent Number: 4,579,216

[45] Date of Patent: Apr. 1, 1986

[54] RETURNABLE CONTAINER REDEMPTION METHOD

[75] Inventors: Bruce H. DeWoolfson; Darrell J. Smith, both of Arlington, Va.

[73] Assignee: Environmental Products Company, McLean, Va.

[21] Appl. No.: 651,709

[22] Filed: Sep. 17, 1984

[51] Int. Cl.[4] ..... G07F 7/06

[52] U.S. Cl. ..... 194/212; 100/902

[58] Field of Search ..... 194/4 C, 4 E; 100/DIG. 2, 902; 209/524; 221/2, 7, 1

[56] References Cited

U.S. PATENT DOCUMENTS 4,285,426 8/1981 Cahill .

4,371,071 2/1983 Abedor et al. .

4,443,697 4/1984 Ryan et al. .

4,519,307 5/1985 La Barge et al. ..... 194/4 C

*Primary Examiner*—Stanley H. Tollberg

*Attorney, Agent, or Firm*—Finnegan, Henderson, Farabow, Garrett & Dunner

[57] ABSTRACT

The method of redeeming returnable containers includes a plurality of remotely-located machines receiving returnable containers and storing information about the numbers of such containers received according to different values of an identifying parameter. A central coordination facility accesses the stored information and determines how many returned containers the different facilities have collected, and ensures that all parties are properly reimbursed.

8 Claims, 10 Drawing Figures

UNIVERSAL
PRODUCT CODE

RETURNABLE CONTAINER REDEMPTION METHOD

BACKGROUND OF THE INVENTION

The present invention relates to the field of reverse vending machine systems. Reverse vending machines distribute valuable tokens, like coins or coupons, when returnable containers are redeemed.

In the past several years, industry, government and the public have shown renewed interest in returnable containers, like cans and bottles. Such interest arises largely from increasing concerns for ecology, energy efficiency, and economy. Many ecologists advocate a requirement that all containers be returnable because of the ecologists' belief that redeemable containers are less likely to be descarded as litter. In addition, with advanced technology, it now takes less energy to recycle certain materials from old containers than it does to use raw materials. Recycled materials have also become more economical than certain raw materials because of the rapidly increasing costs of mining.

The most common mechanism for inducing consumers to return beverage containers is an economic reward for such return. This reward is typically either a deposit refunded to the consumers when empty containers are returned, or else money paid to consumers who return empty containers. Many states have taken legislative action to require a deposit to induce return of empty containers. These states, known as "mandatory deposit" states, generally require the container distributors to charge retailers a certain amount per container and require the retailers in turn to charge their customers a deposit, usually a nickel, for each container sold. When the consumers in these states return the empty containers, the retailers must refund the deposit. Each distributor in these states must then collect from the retailer all the returned containers having that distributor's brands and must pay back to the retailers the deposits plus handling fees. Such handling fees generally range from one to two cents per container. Presently, the mandatory deposit states include Connecticut, Delaware, Iowa, Maine, Massachusetts, Michigan, New York, Oregon, and Vermont.

Although simple at face value, the laws in mandatory deposit states present substantial practical problems for retailers and distributors. Since the distributors are required to collect only their own brands from retailers, the retailers must first sort all the returned beverage containers manually and then store the sorted container for pick-up by the appropriate distributor. This system causes retailers manpower problems due to sorting and space and sanitation problems due to storage of the containers.

A further problem which retailers face in mandatory deposit states is delay in receiving reimbursement from distributors. After returning the deposits to their customers, retailers must wait until the distributors collect the containers and their accounting staffs process the collection paperwork to get the money back for those deposits. Seldom do the one to two cents per container handling fees compensate for this delay or for the retailers' other costs.

Distributors also have major problems in mandatory deposit states. They must commit additional facilities, manpower and trucks to handle the return and disposition of the empty containers, and they must coordinate their full goods operations with the handling of empties.

The distributors also have large problems with accounting and container count verification, as do retailers.

In "voluntary deposit" states, where the retailer is not required to take back empty beverage containers, problems also exist. Recycling in these states is driven by the desired of container producers, as well as by heavy users of container materials made of aluminum and glass, to recover and recycle the materials in those containers. Unlike mandatory deposit states, most programs involved in voluntary deposit states take place in coordination with these container producers. The accounting problems, however, are still significant for the sellers of beverages in returnable containers.

The recovery of used aluminum for its scrap value is an established industry and the recovery and reuse of glass is gaining popularity. Traditional methods of aluminum recovery generally involve collection and delivery of recovered metal to scrap yards. As aluminum's value increases and as bauxite, which is the ore from which aluminum is smelted, becomes more expensive to import, many manufacturers of aluminum containers have developed more concentrated recycling efforts. Such efforts, however, are generally manual.

Certain companies have in response developed reverse vending machines. One type of reverse vending machine, called a bulk feed machine, is placed in a shopping center parking lot. Generally, bulk feed machines only determine whether returned cans are non-ferrous, and if so, the machines pay according to weight. Such machines are used in voluntary deposit states.

Another type of reverse vending machine is a single feed device which is typically placed inside stores. One example of this machine is the Cash for Cans machines manufactured by Environmental Products, Inc., of McLean, Va. Single feed devices typically reimburse consumers for return of the proper type of containers (i.e., aluminum cans). These devices usually do not attempt to perform any accounting beyond the counting of the total number of containers processed.

While reverse vending machines offer some improvement over purely manual methods of container redemption, the accounting and storage problems described above still remain.

One objective of the present invention is to alleviate the accounting, manpower and storage problems that distributors and retailers currently have in redeeming returnable containers.

Another objective of the present invention is to reduce the number of retailers whom each distributor must contact for collection of return containers and reimbursement for such containers.

Yet another objective of the present invention is to accelerate accurate reimbursement.

SUMMARY OF THE INVENTION

The redemption method of this invention solves the problems attendant conventional redemption methods and achieves the objectives of this invention by not only reducing the storage space and manpower requirements of distributors and retailers, but also by greatly simplifying the distributor collection and retailer reimbursement. This is accomplished by central coordination of a number of reverse vending machines. Each machine counts the total number of redeemed containers and counts the numbers of such containers which have certain values of a specified parameter, for example brand and package type information on the Universal Product Code (UPC). The The remote machines store this information and a central coordination facility gathers the stored information from the remote facilities and reconciles the accounts of the retailers and distributors for all the containers redeemed. The individual containers thus need not be sorted or handled separately and all of the redeemed containers are crushed by the reverse vending machines, thus saving storage space. Furthermore, by transmitting the accounting information to a central facility connected to several similar devices, the accounts between the distributors and retailers are quickly and accurately reconciled.

In particular, the method for redeeming returnable containers of this invention comprises the steps of: receiving the containers by a plurality of remotely-located machines; sensing, by each of the machines, product code data on the containers, the product code data containing a specific identifying parameter different values of which correspond to different facilities; dispensing a valuable token upon sensing certain product code data; storing, by each of the machines, information corresponding to the sensed product code data according to different values of the specific identifying parameter in the product code data; combining, by a central facility according to the different values of the identifying parameter, after the stored information from each of the remotely located machines, comparing the combined information for each different identifying parameter value with a stored amount corresponding to that identifying parameter value to determine a deviation from the stored amount; and recording each deviation for transmission to the facility corresponding to each different value of the identifying parameter.

The accompanying drawings which are incorporated in and which constitute a part of this specification, illustrate an embodiment of this invention and, together with the description of the preferred embodiment, explain the principles of the invention.

DESCRIPTION OF THE PREFERRED EMBODIMENT

Reference will now be made in detail to a presently preferred embodiment of the invention, an example of which is illustrated in the accompanying drawings.

Figure 1:
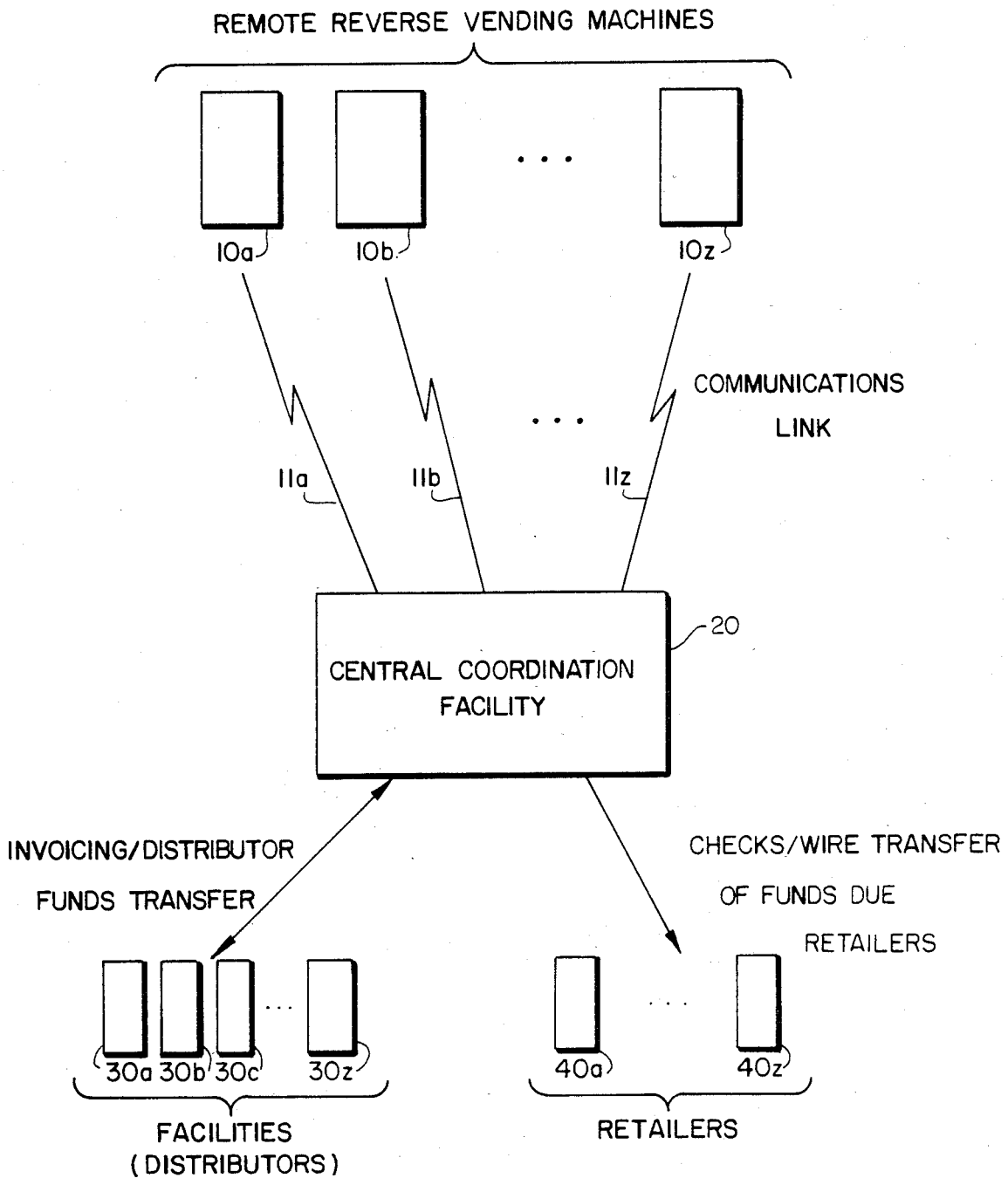
FIG. 1 shows a block diagram of a system for implementing the method of redeeming returnable containers of this invention.

FIG. 1 shows a system diagram which can be used to implement the method of this invention. There are four general system components in FIG. 1. One component is the remotely-located reverse vending machines which are shown generally as 10*a*–10*z* in FIG. 1. These machines are located, for example. in stores or public buildings. As will be described in detail below, these machines receive and identify containers, and reimburse persons returning the containers. Reverse vending machines 10*a*–10*z* also keep track of the total numbers of containers received and record how many of those containers have different values of a specific identifying parameter. An example of such a parameter is the brand information reflected in the containers' Universal Product Code ("UPC"), and the different values of this parameter can be the different brands and package types of returnable containers.

Machines 10*a*–10*z* are connected via communication lines 11*a*–11*z* to a central coordination facility 20. Preferably, the communication lines 11*a*–11*z* are telephone links and, as described below, the remotely-located machines as well as the central coordination facility each contain modems to communicate over such links. The details of the central coordination facility will also be discussed below, but generally, such a facility includes a host data processor or mainframe which receives and processes information from all the remotely located machines and determines the total number of containers received frofm all the machines for each different value of the specific identifying parameter.

Facilities 30*a*–30*z* each correspond to a different value of the identifying parameter. If that parameter is brand information, the facilities may either be distributors or manufacturers of the different brands. Each facility 30*a*–30*z* is assigned to certain machines 10*a*–10*z*, and is responsible for collecting the returned containers received by those machines. The link between facilities 30*a*–30*z* and central coordination facility 20 can be a physical link, like a hardwire link or a telephone data connection. The facilities 30*a*–30*z* can also coordinate with facility 20 via the mail.

Retailers 40*a*–40*z* are shown separate from machines 10*a*–10*z* in FIG. 1, but in reality, machines 10*a*–10*z* are located in the retailers' stores. When central coordination facility 20 determines the numbers of containers received, it calculates the amounts due to retailers 40*a*–40*z* and pays them either by check, which can be automatically printed, or by effecting an electronic funds transfer. The link between retailers 40*a*–40*z* and the central facility 20 can be the same as between facility 20 and facilities 30*a*–30*z*.

For each facility 30*a*–30*z*, the central coordination facility 20 determines the total number of containers received by all the remote machines 10*a*–10*z* which containers have the parameter values corresponding to that facility. Central facility 20 then calculates one value, for example for handling and deposit fees, corresponding to that number and another value, for example the scrap value, corresponding to the total number of containers collected by the corresponding facility. In this manner, the central coordination facility 20 settles accounts between itself and facilities 30*a*–30*z* without requiring manual sorting and storage by the retailers and without requiring the facilities to contact all of the retailers. This process is described in detail below.

Figure 2:
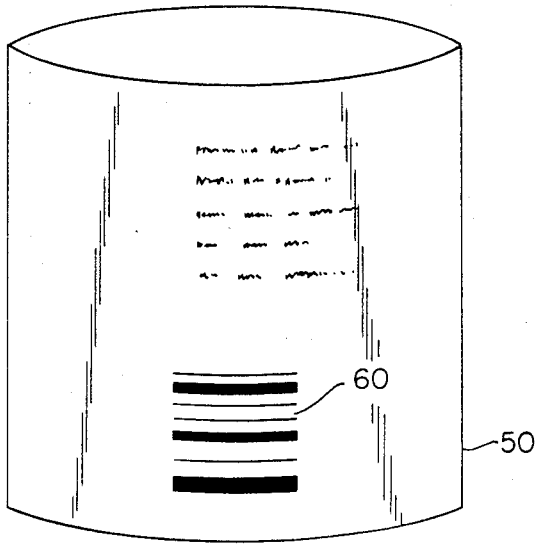
FIG. 2 shows a container having Universal Product Code information on it.

In the embodiment described below, each container being redeemed contains a Universal Product Code (UPC) as product code data. FIG. 2 shows a UPC 60 on a can 50. The reverse vending machines examine the UPC on the containers for a specific identifying parameter, such as the brand information.

Figure 3:
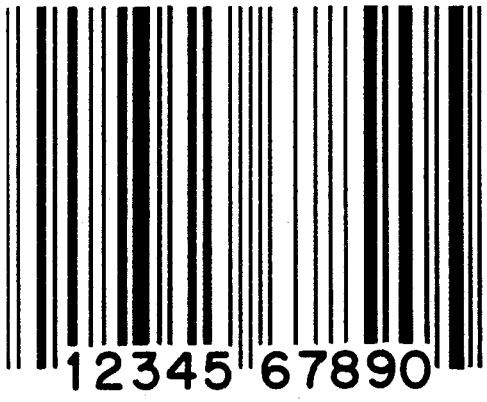
FIG. 3 shows an example of a Universal Product Code.

FIG. 3 shows a ten digit UPC in greater detail. The distributor/manufacturer information is found in the first five digits and the brand information is found in the last five digits. In the present invention, different values of the UPC together with the location of the machine identify the distributor or manufacturer responsible for the deposit reimbursement and handling fees due the retailers.

Figure 4:
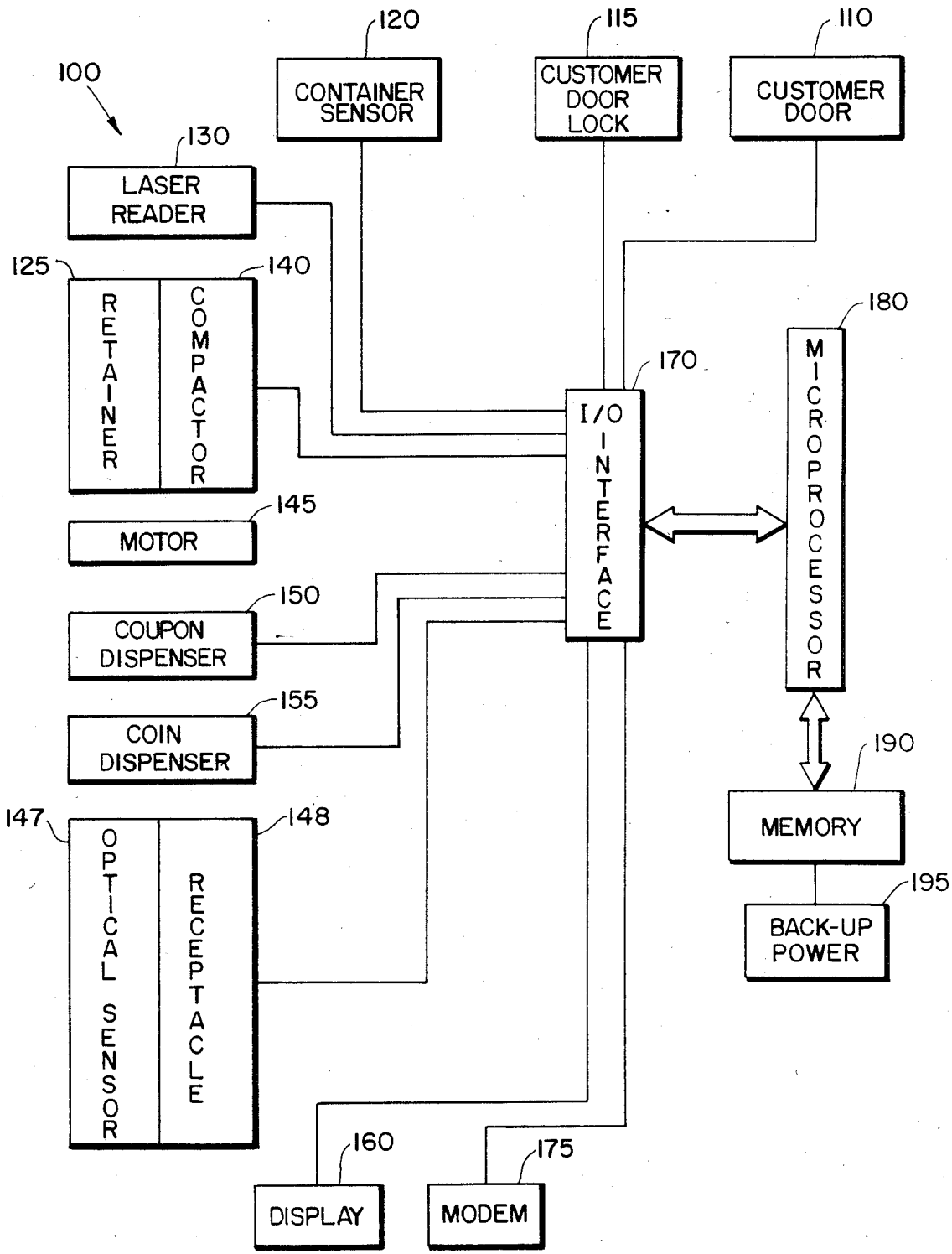
FIG. 4 shows a block diagram of certain components of a remotely located reverse vending machine of this invention.

FIG. 4 shows the details of an operational subsystem 100 in a typical remotely-located reverse vending machine that can be used with this invention. In the present invention, the reverse vending machines, and especially their subsystems 100, include features which are available because the machines are used in the method of this invention. Subsystem 100 is shown in FIG. 4 as including a customer door 110 into which customers insert individual containers for redemption. Door 110 contains a "Door Closed" switch to indicate the position of door 110. Such monitoring is necessary for several reasons, especially to ensure that the customer's hand is free before subsequent operation begins. Door 110 is spring-mounted so that it is normally closed unless opened by a customer.

Subsystem 100 also contains a door lock 115 which includes two solenoid-controlled lock pins to lock customer door 110 and prevent it from being opened during certain portions of the machine's operation, especially the crushing operation described below. The door lock 115 also contains a microswitch to indicate whether both locking pins are engaged.

Display 160 in subsystem 100 contains messages for the customers and for store personnel. The display 160 can take many forms such as an LED or LCD panel or a metal panel into which messages are etched that become visible to the customer when a light behind the particular message is illuminated. Display 160's messages include "Machine Ready—Insert Container," "Rotate Container—Bar Code Up," "Non-Deposit—Non-Participating Container—Please Remove," "Deposit Container—Thank You," "Sorry Machine Full—Contact Store Manager," "Machine Malfunction—Contact Store Manager," and "To Receive Payment Push Button." The meaning of these messages will be clearer from the description of subsystem 100 which follows.

Container sensor 120 determines whether a container is present in the machine for redemption. In the preferred embodiment, when inserted through customer door 110, the container is held in a "bathtub." Preferably, a lightbeam across the bathtub is broken when a container is present. If no light is sensed across the bathtub, then the subsystem assumes that a container is present. If the lightbeam goes across the bathtub unimpeded, the bathtub is empty and no container is present. If the reverse vending machine is receiving metal cans, container sensor 120 also includes sensing coils in the bathtub to determine the type of metal in the cans.

Laser reader 130 is a precision laser optic device and is used to read the UPC on the container in the bathtub. The laser reader 130 is preferably an MS-165 Laser Scanner made by Metrologic, Inc. The output of reader 130 is either the decoded contents of the code itself or a signal indicating that the UPC could not be read.

Subsystem 100 also contains a retainer 125, a compactor 140 and a motor 145. Prior to compacting, a container drops from the bathtub into retainer 125 which holds the containers during compacting. When properly activated, motor 145 causes compactor 140 to crush the can in container 125. If the containers are cans, compactor 140 and motor 145 are preferably part of a Dumore Crushing System.

The position of compactor 140 can be monitored to determine its progress. If the object being crushed offers an unacceptably high resistance for compacting, then motor 145 stops compacting and reverses. Retainer 125 is also spring-loaded to allow containers that are too heavy to drop without being crushed.

At the end of crushing, retainer 125 opens to drop the crushed can into receptable 148 which contains a drip sanitary tray in its bottom. An optical sensor 147 lies between retainer 125 and 148. Optical sensor 147 comprises an optical emitter and detector. When the lightbeam between the emitter and detector is broken, sensor 147 emits a signal which indicates that a container has dropped from retainer 125 into receptacle 148. Receptable 148 also indicates when it is full to prevent the machine from accepting additional containers before the receptacle is emptied.

Subsystem 100 also contains a coupon dispenser 150 and a coin hopper and dispenser 155. Coupon dispenser 150 can be a standard coupon feed wheel that dispenses the appropriate number of coupons upon receipt of the correct commands. There is also a coin hopper 155 which dispenses coins or tokens upon the appropriate command. Such coupon and coin dispensers are well-known in the art.

Elements 110–155 of subsystem 100 are all coupled to microprocessor 180 through an I/O interface 170 so signals from those elements can be sent to microprocessor 180, and so microprocessor 180 can send commands to each one of those elements. Microprocessor 180 is preferably a 2764. Memory 190 is connected to microprocessor 180 for storage of commands and data. Backup power source 195 is a lithium battery which insures that the information in memory 190 is not lost when external power is lost.

The remaining element in FIG. 4 which has not yet be described is modem 175 which is a standard modem for microprocessor communication. Modem 175 can be used to communicate with the central coordination facility 20 in FIG. 1 via one of communication lines **11*a*–11*z***.

Figure 5:
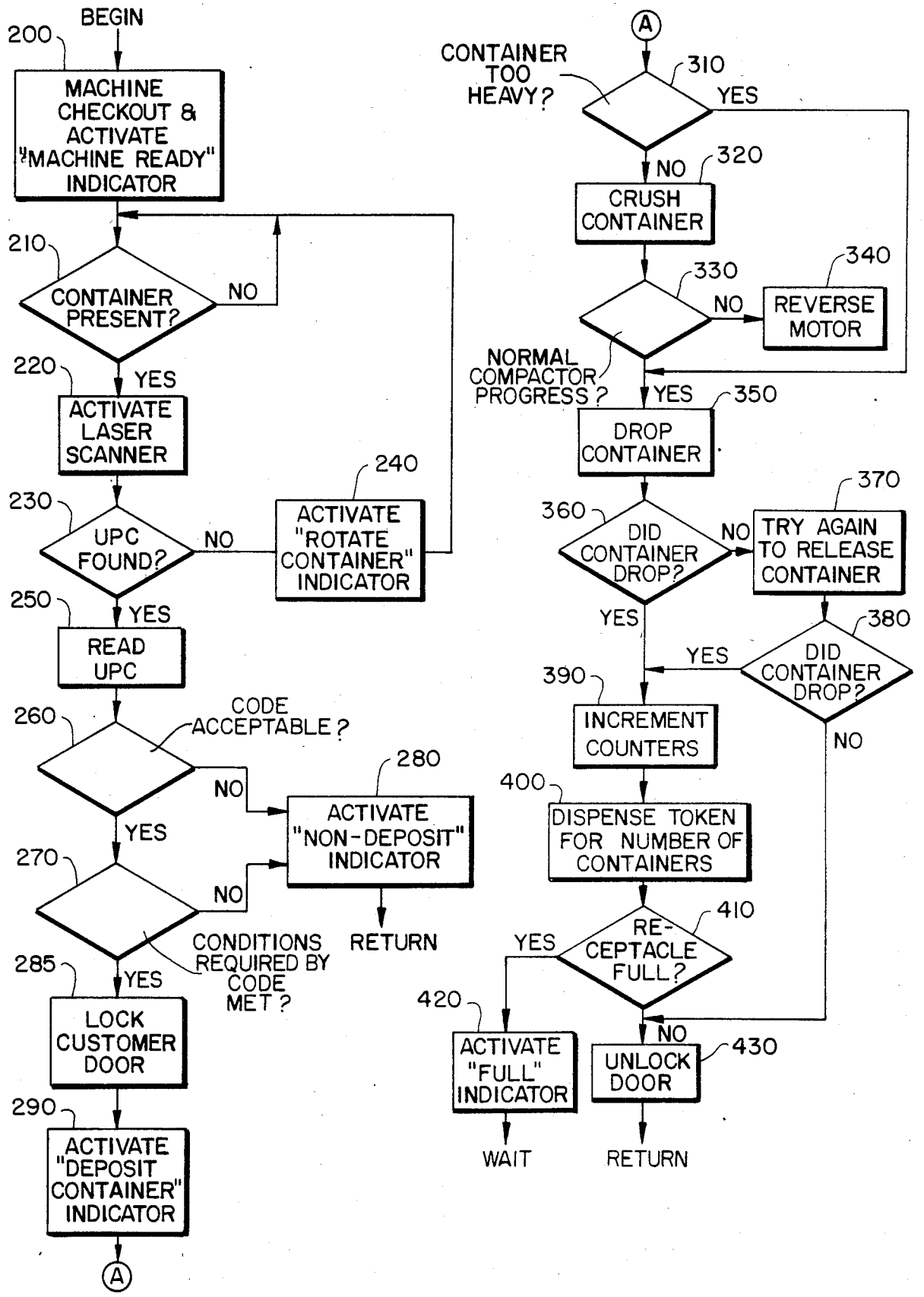
FIG. 5 shows a flow diagram for the operation of the machine in FIG. 4.

FIG. 5 shows the general operation of the remotely-located remove vending machine whose operational subsystem appears in FIG. 4. In step 200, microprocessor 180 performs a machine check-out. If microprocessor 180 finds any malfunctions that it cannot correct, then it lights the "Machine Malfunction" light in display 160. If the checkout is successful, then microprocessor 180 lights the "Machine Ready" indicator on display 160. When that indicator is lit, then customer door lock 115 is unlocked allowing customer door 110 to be opened to receive containers.

After a customer opens customer door 110 and places a container in the bathtub, sensor 120 informs the microprocessor that a container is present, as shown by step 210 in FIG. 5. At this time, microprocessor 180 activates laser scanner 130 to read the UPC on the container. If laser reader 130 cannot find a UPC in step 230, then in step 240, microprocessor 180 lights the "Rotate Container" message on display 160 instructing the customer to rotate the can and place the bar code up. Microprocessor 180 then unlocks door lock 115 so the customer can rotate the can.

If the code can be read, then in step 250, microprocessor 180 acquires from laser reader 130, via I/O interface 170, the information in the container's UPC 130. Microprocessor 180 next determines in step 260 whether the UPC read is acceptable. An acceptable code is one corresponding to a container which the reverse vending machine has been programmed to accept. Microprocessor 180 makes its determination of acceptability by checking a list of codes stored in memory 190.

Figure 6:
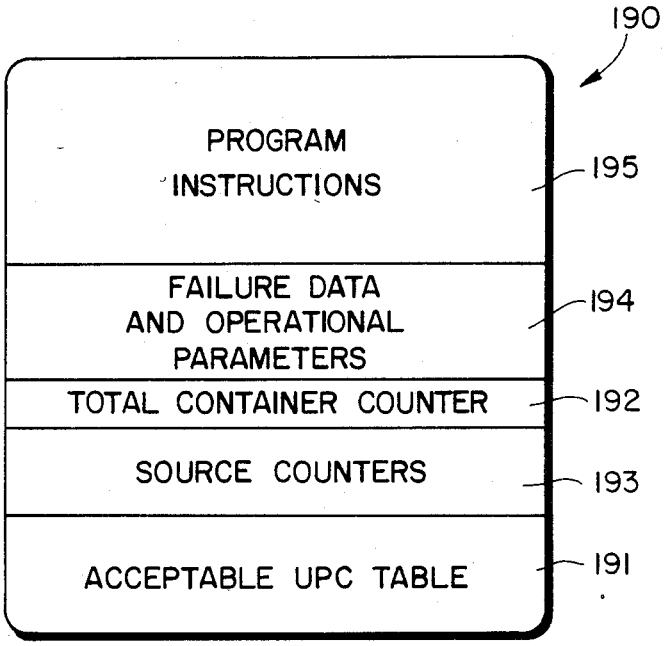
FIG. 6 shows an example of the memory allocation for the memory shown in FIG. 4.

FIG. 6 shows a map of memory 190 containing several data storage areas. The memory map is not intended to indicate relative storage locations for the information depicted, but rather to indicate the types of information stored in memory 190. Program instructions are stored in area 195 and failure data and operational parameters are stored in areas 194. Counters and tables occupy areas 191–193.

In area 191, memory 190 stores the acceptable product codes. Microprocessor 180 checks the UPC information on the container read by laser reader 130 against the entries in code table 191. If microprocessor 180 finds a match, then the UPC read from the container contains an acceptable code.

Some acceptable codes have certain additional requirements which must be met before the container with that code can be accepted by the machine. One requirement may be that, if the container is a can, it must be aluminum. The microprocessor then polls sensor 120 to determine whether the can is indeed aluminum and if so, then the condition has been met and the microprocessor can proceed. In step 270, microprocessor 180 ensures that all conditions required by the UPC are met.

If the UPC read from a can is not an acceptable code, or if the conditions for an acceptable code are not met, then in step 280, the microprocessor 180 activates a "Non-Deposit—Non-Participating" indicator on display 160. This indicator is flahsed until the object is removed. The microprocessor, after sensing that the container is removed, returns either to the checkout step 200 or to the can present sensing step 210.

If the microprocessor determines that the UPC code on a container is acceptable and that all conditions for that container have been met, microprocessor 180 orders customer door lock 115 to lock the customer door 110 in step 285. The microprocessor 180 also in step 290 activates the "Deposit Container" indicator on display 160.

A spring at the bottom of retainer 125 will cause retainer 125 to open if the container is too heavy. If, in step 310, the container to too heavy, then the can may not be empty and it will not be crushed. If the container is not too heavy, microprocessor 180 orders compactor 140 and motor 145 to crush the container in step 320 after ensuring that the container is still present.

Microprocessor 180 monitors the position of the compacting motor 145 to determine its progress. If, the step 330, the microprocessor determines that the crushing motor's progress is too slow, in step 340 microprocessor 180 orders the motor to reverse and drop the container into receptacle 147. This condition can occur if there is something abnormal about the container or something inside the container which prevents it from being crushed as it should. To prevent damage to the compactor or to the motor, the microprocessor 180 stops the crushing operation, reverses the motor, and then removes the container from retainer 125.

If the microprocessor determines that the motor's progress is normal, then in step 350, after the container is crushed, microprocessor 180 orders retainer 125 to open and to drop the container into receptacle 147.

As described above, if the container drops into receptacle 147, the container will break an optical beam and is sensed in step 360. If the container does not drop, then the microprocessor orders the retainer 125 to drop the can again and microprocessor 180 again determines whether the container dropped. Such checking as described with regard to steps 370 and 380 can proceed any number of times.

The container still may not drop after repeated attempts because a customer has tied a string around the container and tried to pull the can back up to resubmit it. If microprocessor 180 never senses the can dropping from the retainer, then it will merely unlock the door (step 430) and not dispense any tokens.

If the microprocessor does sense that the container has dropped, in step 390 it increments the total container counter 192, shown in FIG. 6, and also increments one of the source counters 193 corresponding to the value of the identified parameter of the container's product code information. Counters 193 each correspond to a different value of an identifying parameter, for example, different brands or types of containers in the UPC. In FIG. 6 counters 193 are called source counters. When microprocessor 180 receives the UPC information from the laser reader 130, it identifies the appropriate source counter and increments that counter when it detects the crushed container dropping into receptacle 147.

In step 400, microprocessor 180 determines the appropriate number of tokens to dispense for the containers submitted. The tokens could be advertising coupons or coins, or both. Microprocessor 180 orders dispensers 150 and 155 to dispense the proper coupons or coins for the containers submitted. The token dispensing operation may also occur after a customer submits all the containers. This would require a separate "pay" button which a customer would push after all the containers have been submitted.

Next, the microprocessor determines in step 410 whether receptable 147 is full. If it is, then in step 420 the microprocessor activates the "Machine Full" indicator in display 160 and waits until the receptacle is emptied. If the bag is not full, then in step 430, microprocessor 180 unlocks the customer door and the machine returns either to step 200 or step 210.

The container count information stored in memory 190 can be accessed in a variety of ways. For example, using I/O interface 170, the value of the counters can be read out of the memory using standard RS-232 protocol. Standard RS-232 protocol software is available for virtually every microprocessor. The counter information can then be transmitted to the central coordination facility for the operations described below.

Figure 7:
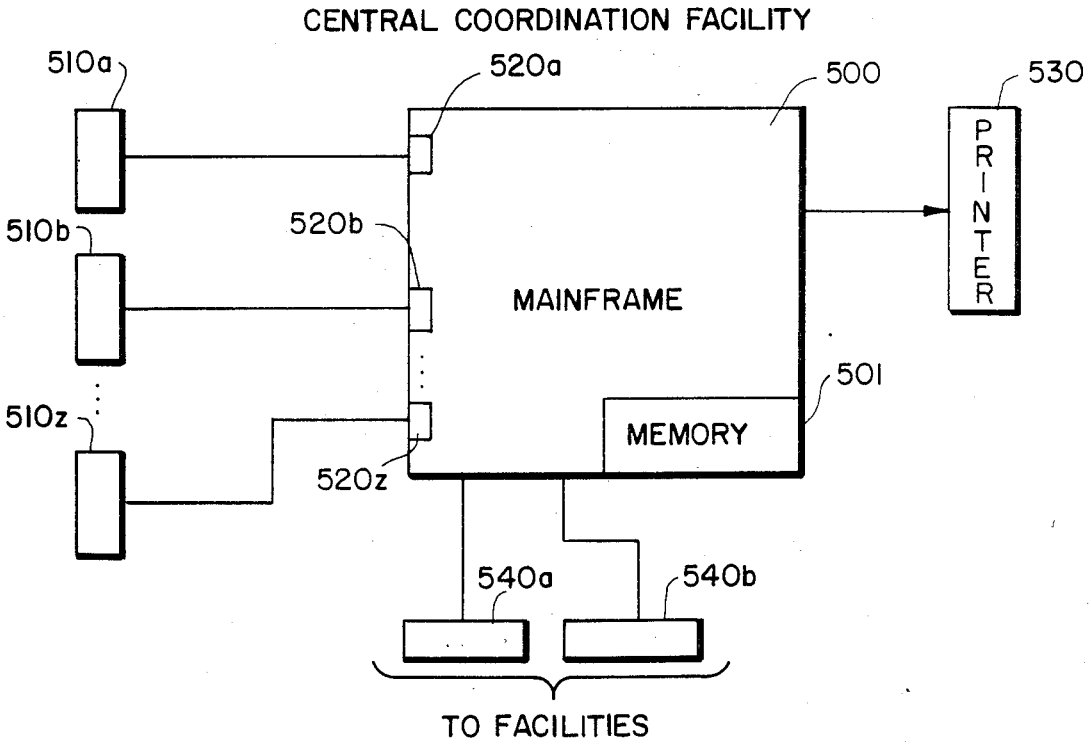
FIG. 7 shows a block diagram of the central coordination facility shown in FIG. 1.

Alternatively, the information can be accessed remotely by the central coordination facility via modem 175. An example of a central coordination facility with such capability is shown in FIG. 7. In FIG. 7, a mainframe computer 500 is connected to a plurality of modems 510*a*, 510*b*, . . . 510*z* and a plurality of automatic dialers 520*a*, 520*b*, . . . 520*z*. Mainframe 500 polls the remotely-located reverse vending machines by causing the automatic dialers 520*a*–520*z* to access the individual remotely-located machines via the modems 510*a*–510*z* at the central coordination facility and the modems, such as modem 175 in FIG. 4, at the remotely-located machines. Once a communication link is established, the mainframe 500 can read the information from the remotely-located machine's memory 190 and store that information in the mainframe's own memory 501.

Figure 8:
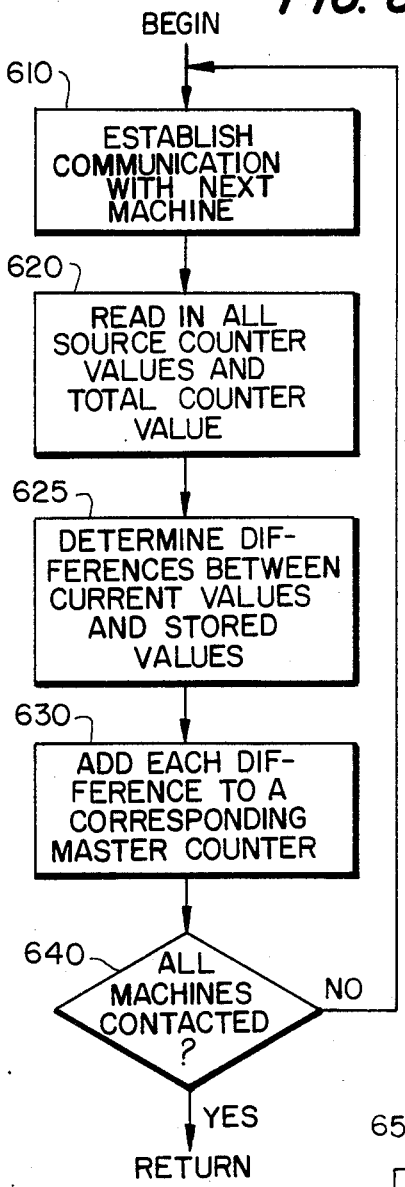
FIG. 8 shows a flow diagram for accessing information from the remotely-located machines by the central coordination facility.

The operation of mainframe 500 is shown in greater detail in FIG. 8 which shows a process for polling the remotely-located machines. The process in FIG. 8 is repeated periodically, for example every week or month. In step 610, mainframe 500 establishes communications with the next remotely-located machine via automatic dialers and the modems as just described.

Once communication is established, then, as indicated in step 620, mainframe 500 reads in the contents of memory in the machine, i.e., the values of the total container counter and of each source counter. As indicated above, the UPC counts in source counters 193 are stored in memory 190 of each machine.

The value in each source counter reflects the cumulative number of containers from that source (i.e., with that UPC brand) redeemed through that particular machine. The counts in the remote reverse-vending machine counters are never reset to avoid inadvertent loss of data, for example, from transmission difficulties.

Memory 501 of manufacture 500 contains the previous UPC source counts from each machine. In step 625, mainframe 500 determines the total number of containers redeemed through a machine during the last period or cycle, and the number of redeemed containers of each brand redeemed during that cycle. It makes its determination from the differences between the present counts from the source counter and the price counts made during the prior cycle.

Memory 501 of mainframe 500 in the central coordination facility contains master source counters (not shown). These master counters correspond to the same identifying parameter values, in this example brand information, as do the source counters at each machine. The master source counters accumulate the total number of containers of each brand which have been redeemed at all the machines. In step 630, the value stored in each machine source counter is added to the corresponding master source counter in memory 501.

In step 640, mainframe 500 determines whether all the remotely-located machines have been contacted for access to their counter values. If not, steps 610–640 are repeated until all those machines are contacted. If they have all been contacted, then the mainframe is finished with this procedure.

Once in possession of the count information, the central coordination facility allocates costs and revenues among the retailers and among the different facilities corresponding to the different identifying parameter values. It will be assumed in the ensuing discussion that the facilities are distributors of containers having a particular brand, but it must be understood that this need not be the case. For example, a facility could be a manufacturer of the container or a distributor of only one particular type of containers, e.g., cans or bottles.

To participate in the redemption method of this invention and to have containers with their code which will be accepted by the remotely-located reverse vending machines, retailers and distributors agree to accept the accuracy of the procedures performed by the remotely-located machines and the central coordination facility which are described below. The distributors also agree to collect all the compacted containers periodically from certain remotely-located machines, at retailers' sites, which are assigned to each distributor. This means that, unlike present systems, in the method of this invention the distributor collects containers from other distributors, since each remotely-located machine accepts containers for different brands. Once the distributor agrees to these conditions, the containers having product code data with identifying parameter values corresponding to that distributor are entered into the acceptable code tables (e.g., table 191 in FIG. 6) of the machines.

Figure 9:
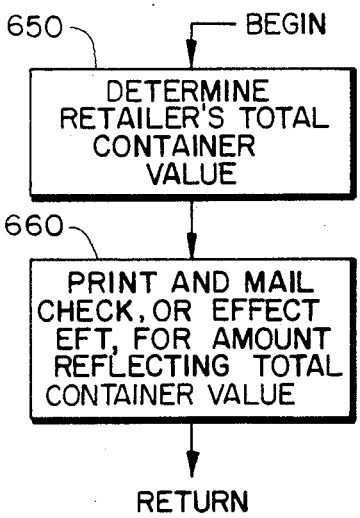
FIG. 9 shows a flow diagram for reimbursing retailers.
Figure 10:
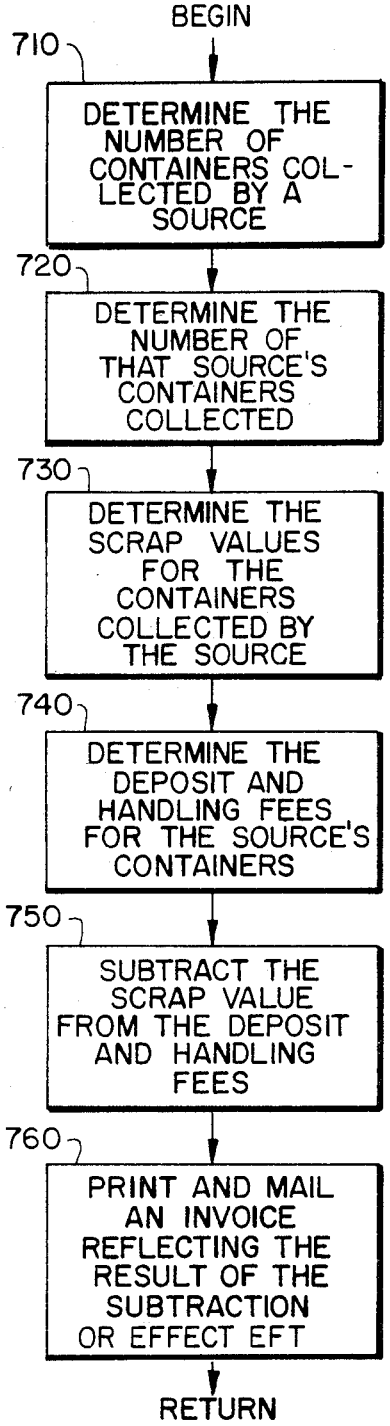
FIG. 10 shows a flow diagram for adjusting the accounts.

With this arrangement understood, the remainder of this invention can be explained with the aid of FIGS. 9 and 10. FIG. 9 shows the procedure for reimbursing the retailers. Reimbursement is necessary because the retailers have the responsibility for stocking the machines with coins. FIG. 10 shows the procedure for adjusting the accounts of facilities, which in this example are distributors.

In step 650 of FIG. 9, the mainframe determines the total container value for each retailer. By knowing which machines are controlled by which retailer, the mainframe determines, from the total container count of those machines, how many containers were received by each retailer's machines. This determination corresponds to the amount of money which that retailer had to supply to the reverse vending machines.

Once this determination is made, in step 660, the mainframe prints a check or electronically transfers funds reflecting that total value. The printing is accomplished via printer 530. Once printed, the check is mailed to the retailer. Alternatively, mainframe 500 can cause an electronic fund transfer to the accounts of the retailers.

FIG. 10 is a flow chart demonstrating how the container sources or facilities 540*a*, 540*b*, in this case distributors, are invoiced. In step 710, mainframe 500 determines the number of containers collected by a source (distributor). Preferably, mainframe 500 makes this determination in two ways. First, each source or distributor reports the total weight of the containers collected. That weight is then converted into a value representing the number of containers using a predetermined average container weight value.

Mainframe 500 checks its estimate by first determining from which remotely-located vending machines that source has collected crushed cans, and then determining the total number of cans received during the last cycle from those machines.

In step 720, mainframe 500 determines the number of that source's containers collected from all the remote vending machines during the last cycle or period. Mainframe 500 accomplishes this by subtracting from the current value of the proper master source counter the previous value of that counter.

Next, in step 730, mainframe 500 determines the scrap value for the containers collected by the source. This is done by using the current market value for the material in a container and multiplying that by the total number of containers collected or by the weight of those containers.

In step 740, mainframe 500 determines a total deposit and handling fee for a source using the previouslydetermined total number of a source's containers collected. The deposit fee per container is usually set by law and the handling fee is also on a per container basis and is set by contract. The total fee is determined by multiplying the total number of that source's containers by the total handling plus deposit fee per container.

In step 750, the mainframe subtracts the scrap value from the deposit and handling fees to determine an invoice amount, and in step 760, an invoice reflecting that amount is printed and mailed to the corresponding source.

The above discussion has centered around facilities or sources of containers, and it has been assumed that such sources or facilities correspond to distributors of the container. The discussion could just as well have been made using the term "initiator of deposit" instead of "container source," and the source or initiator could have been a manufacturer rather than a distributor.

As can be seen, the method of this invention achieves its objectives by greatly simplifying the procedures of conventional methods. The central coordination facility, in communication with the remotely-located machines according to this invention, eliminates the need for retailers to sort containers manually and store uncompacted containers for pickup by the manufacturers or distributors. The present invention also eliminates the need for each distributor or manufacture of container to deal directly with all the retailers for collection of returned containers. Each distributor or manufacturer need only deal with a certain fixed number of retailers to coordinate container pickup and with the central coordination facility. Furthermore, each retailer need only communicate with the central coordination facility.

The retailer is also reimbursed very quickly since he need not wait to receive reimbursement from each manufacturer or distributor for the money paid to customers returning containers. Instead, the central coordination facility pays the retailer based on the total count in the retailer's machines.

The method of this invention allows the reverse-vending machines used in this invention to have the features described above, many of which are not available with conventional machines. Thus retailers, by virtue of the fact that containers redeemed at their stores are crushed, need not devote the storage space required by manual methods of deposit container redemption. They need only take the crushed container to a location for pickup by the assigned facility.

It will be apparent to those skilled in the art that modifications and variations can be made in the redemption method of this invention. The invention in its broader aspects is not limited to the specific details, representative methods, and illustrative example shown and described. Departure may be made from such details without departing from the spirit or scope of the general inventive concept.

What is claimed is:

1. A method of redeeming returnable containers comprising the steps of:

receiving said containers by plurality of remotely-located machines;

sensing by each of said machines, product code data on said containers, said product code data containing a specific identifying parameter, different values of which each correspond to a different facility;

storing, by each of said machines, information corresponding to said sensed product code data according to said different values of said specific identifying parameter in said product code data;

combining, by a central processing facility according to said different values of said specific identifying parameter, said stored information from each of said remotely-located machines;

comparing said combined product code data for each of said different identifying parameter values with a stored amount corresponding to that identifying parameter value to determine a deviation from said stored amount; and recording each said deviation for transmission to the facility corresponding to each different value of said identifying parameter.

2. The method in claim 1 wherein said identifying parameter indicates a source of the container having said product code data and wherein storing step includes the step of storing said information according to said source indication; and wherein said recording step includes the steps of:

subtracting, for each said facility, said corresponding deviation from an amount relating to said corresponding combined product code data to determine an invoice amount; and recording each said invoice amount for transmittal to a facility corresponding to each indicated source.

3. The method of claim 2 wherein said container source indicator is brand information and said corresponding facility is a distributor and wherein said recording step includes the step of transmitting said invoice amounts to each distributor.

4. The method of claim 2 further including the step of printing invoices according to said invoice amounts.

5. The method of claim 4 including the step of mailing said invoices and checks to each said facility.

6. The method of claim 2, including the steps of effecting electronic fund transfers in the amounts of said invoice amounts.

7. The method of claim 1 including the steps of:

determining the presence of acceptable value of said identifying parameter; and dispensing valuable tokens for containers with acceptable values of said identifying parameter.

8. The method of claim 1 including the steps of:

crushing said containers into a compact form; and storing said crushed containers in a receptacle.

* * * * *